United States Patent [19]

Gardner

[11] Patent Number: 4,608,838

[45] Date of Patent: Sep. 2, 1986

[54] JEWELRY WITH INTERCHANGEABLE FACE MEMBERS

[76] Inventor: Irving Gardner, P.O. Box 294, Hunter, N.Y. 12442

[21] Appl. No.: 730,437

[22] Filed: May 6, 1985

[51] Int. Cl.[4] ..... A44C 17/02

[52] U.S. Cl. ..... 63/29 R

[58] Field of Search ..... 63/29 R, 1 R, 2

[56] References Cited

U.S. PATENT DOCUMENTS

| | | | |
|---|---|---|---|
| 336,063 | 2/1886 | Palmer | 62/29 R |
| 470,751 | 3/1892 | Fink | 63/29 R |
| 895,865 | 8/1908 | Joyce | 63/29 R |
| 1,091,539 | 3/1914 | Schrink | 63/29 R |
| 1,620,252 | 3/1927 | Fischer | 63/29 R |
| 2,778,136 | 1/1957 | Belgard | 63/29 R |
| 3,605,438 | 9/1971 | Chalson | 63/29 R |
| 4,309,879 | 1/1982 | Gretz et al. | 63/29 R |

*Primary Examiner*—F. Barry Shay

*Attorney, Agent, or Firm*—John Maier, III

[57] ABSTRACT

Jewelry, such as a cuff link, with a face member such as a gem or stone mounted in a bezel which can be readily inserted and removed from a base member of a piece of jewelry, such as a cuff link.

7 Claims, 5 Drawing Figures

JEWELRY WITH INTERCHANGEABLE FACE MEMBERS

BACKGROUND OF THE INVENTION

As is well recognized, wearers of jewelry such as cuff links, rings, pins and other items which include face members such as gems or stones, frequently buy a large number of pieces of jewelry to have a variety and to match the jewelry to the particular clothing that they are wearing. This results in a great expense which, without this invention, is necessary. Jewelry has been constructed with face members that can be slid out but the convenience of the removal and the requirement that each face member be the same size has prevented the general manufacture of jewelry with such removable or interchangeable face members. In accordance with this invention an apparatus is provided by which a base member of a piece of jewelry can utilize a varied range of face members both as to type and size without spinning or turning of the face member.

SUMMARY OF THE INVENTION

In accordance with this invention, an apparatus is provided by which face members of various sizes and shapes can be readily replaced on pieces of jewelry, as for example a pair of cuff links. The face member is mounted in the bezel, and after first inserting a spring means, the edges of the bezel are conformed to the face member to form one unit by holding the face member in place without spinning or turning. The bottom of the bezel has a pair of slots through which the prongs of a spring means extend. The spring means includes a pair of prongs each having an arcuate shape extending from a flat plate through the openings in the bezel. The piece of jewelry, as for example a cuff link, is formed from the jewelry base member with a mounting platform on it. The mounting platform has two slots similar to those in the bezel through which the prongs of the spring means fit and due to the arcuate shape of the prongs the bezel with the face member in it is rigidly held in place without possibility of rotation between the mounting platform and the bezel.

DETAILED DESCRIPTION OF THE DRAWINGS

DETAILED DESCRIPTION OF THE INVENTION

Figure 1:
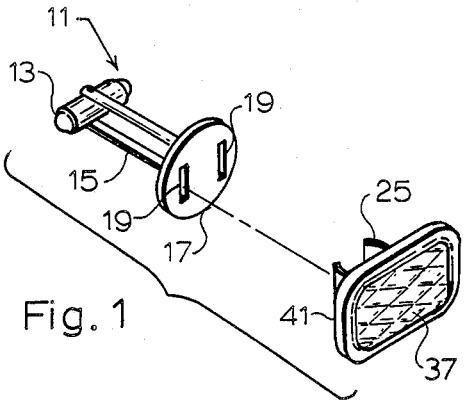
FIG. 1 is an exploded perspective view of a jewelry base member in the form of a cuff link, utilizing the invention and showing the cuff link with the mounting platform and with the face member being oblong and large mounted in a bezel with the prongs of the spring means extending from the bezel.
Figure 2:
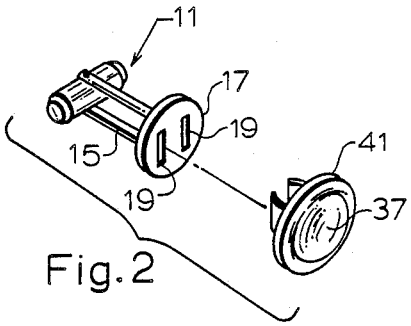
FIG. 2 is an exploded perspective view of a jewelry base member shown as a cuff link similar to FIG. 1 but using a face member of different shape and size, namely smaller and circular with a bezel having a configuration in conformity to the face member.

The invention, best seen in FIGS. 1 and 2 is shown as used with a cuff link as the jewelry base member 11. The jewelry base member 11 can be the basic support form of any piece of jewelry such as a cuff link, ring or pin. The cuff link includes the well known pivotal end 13 and a pair of bars 15 extending to a mounting platform 17. The jewelry base member 11, which is the pivotal end 13 and pair of bars 15, is similar to the basic support portion of a cuff link, as is now available. The mounting platform 17, which is preferably as small as possible and circular, includes two centrally spaced slots of rectangular shape and the mounting platform 17 is flat. A spring means 21 is formed from a flat plate 23 with two prongs 25 which are symetrically located and bent down, each prong being resilient and having an arcuate bend 27. The arcuate bend 27 is such that the prongs 25 bend outwardly from one another with their outside ends 29 directed toward one another.

Figure 3:
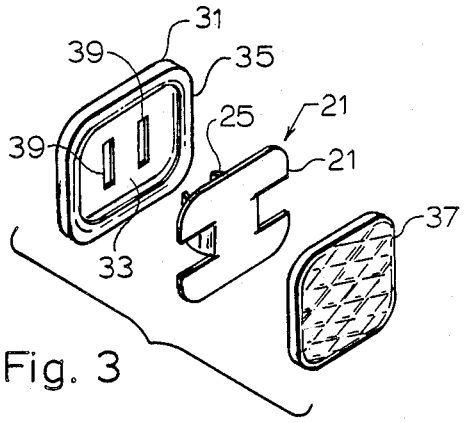
FIG. 3 is an exploded perspective view of the bezel and the spring means and the face member all separated from one another.
Figure 4:
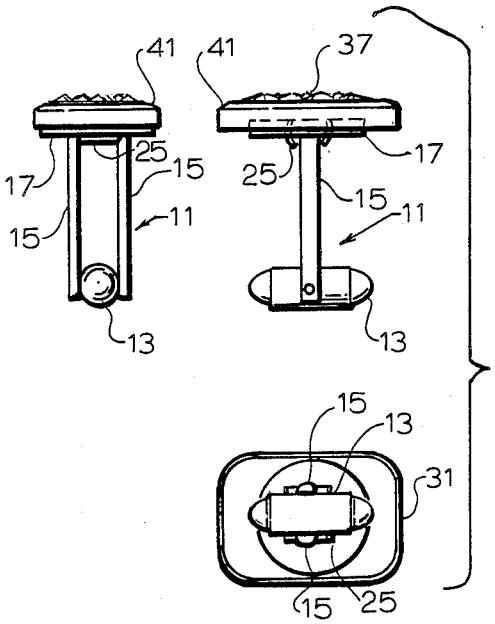
FIG. 4 is a series of three views of the assembled cuff link according to this invention showing the two side elevations at right angles to one another and a top plan view of the cuff link with the face member facing downwardly.
Figure 5:
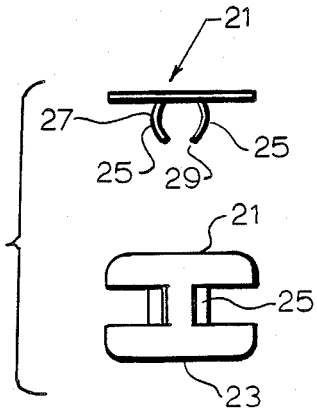
FIG. 5 is a series of two views of the spring means showing a side elevation with the arcuate prongs shown as extending downwardly and a top elevation with the prongs extending downwardly and showing the cut out of the plate from which the prongs are formed.

A bezel 31, as best seen in FIG. 3, includes a surface area 33 and a rim 35 to hold a face member 37 in it. The shape of the bezel conforms to the shape of the face member 37 and the flat plate 23 of the spring means 21 also is shaped to be smaller but preferably similar to the surface area 33 of the bezel 31 to fit within the bezel 31 and against the surface area 33 of the bezel 31. The spring means 21 could be merely U-shaped but this could cause rocking of the face member 37 and the top of the flat plate 23 of the spring means 21 serves properly to mount the face member 37. The spring means 21 is placed into the bezel 31 which also has two slots 39 similarly sized, spaced and shaped to the two slots 19 in the mounting platform 17 and the two prongs 25 of the spring means 21 extend through the two slots 39 in the bezel 31. The face member 37 is then placed in the bezel 31 and clamped in place by crimping the rim 35 of the bezel 31 around the face member 37, such as a gem or stone which sets the face member 37 and makes the bezel 31, the spring means 21 and the face member 37 into one rigid unit 41. With this completed, each face member 37 is retained within its own bezel 31 and includes its own spring means 21. The two prongs 25 of the spring means 21 can then be readily inserted into the two centrally spaced slots 19 in the mounting platform 17 and locked in place due to the arcuate bend 27 of the two prongs 25 but when it is desired to use a different face member 37, the existing face member 37 with its bezel 31 and spring means 21 is pulled from the mounting platform 17 against the strength of the two prongs 25 and the newly-selected bezel 31 with its spring means 21 and face member 37 can be inserted in its place as the one rigid unit 41. The bezel 31, the spring means 21 and the face member 37, when assembled with the face member 37 secured within the bezel 31 by the rim 35 of the bezel 31, form the one rigid unit 41 ready to be snapped into the mounting platform 17 of the jewelry base member 11.

The spring means 21 could be shaped merely as a U without the flat plate 23 but such a design would cause problems with properly setting the face member 37.

By doing this it is possible to use various rigid units 41 having different sizes, shapes and types of face members 37 with any particular type of jewelry be it a cuff link as shown, or a ring, bracelet, broach or other piece of jewelry.

While a preferred embodiment has been shown and described, various modifications and substitutions may be made without departing from the spirit and scope of this invention. Accordingly, it is understood that this invention has been described by way of illustration rather than limitation.

I claim:

1. A jewelry device incorporating means for interchanging a face member for a piece of jewelry comprising:

a face member for a piece of jewelry;

means for rigidly retaining said face member of a piece of jewelry including spring means having a pair of resilient prongs and a bezel with a surface area with an upstanding rim extending thereabout and said spring means including a flat plate located beneath the face member, said pair of resilient prongs being affixed to said flat plate and said surface area having a pair of slots therein through which said pair of resilient prongs extend, a jewelry base member; and a mounting means rigidly secured to said jewelry base member including a platform with a pair of slots in it to receive the pair of prongs.

2. A jewelry device incorporating means for interchanging a face member for a piece of jewelry comprising:

a face member for a piece of jewelry;

a bezel including spring means having a surface area with an upstanding rim extending about the surface area, the shape and size of the surface area being constructed to match the shape and size of the face member and the rim being adapted to be deformed against the face member to hold the face member in place, the surface area of the bezel having two slots symetrically located therein:

a spring means including a flat plate shaped to fit within the rim and against the surface area of the bezel, said spring means having two prongs extending substantially at right angles from the flat plate, said prongs being symmetrically located on said flat plate and being constructed and arranged to fit through the two slots located in the surface area of the bezel, each of the two prongs having an end and having an arcuate shape extending outwardly, the end of each prong being directed inwardly toward the end of the other prong, the flat plate of the spring means being located between the surface area of the bezel and the face member to form one rigid unit;

a jewelry base member; and a mounting plateform rigidly affixed to the jewelry base member including a flat member with two slots through it to receive the prongs of the spring means to hold the bezel and face member and the jewelry base.

3. An apparatus according to claim 2 wherein the flat member is a flat plate.

4. An apparatus according to claim 2 wherein the flat member is a flat circular plate with the two slots through it being substantially symmetrically located on the flat circular plate.

5. A jewelry device incorporating means for interchanging a face member for a piece of jewelry comprising:

a face member for a piece of jewelry;

a bezel including spring means having a surface area with an upstanding rim extending about the surface area, the shape and size of the surface area being constructed to match the shape and size of the face member and the rim being adapted to be deformed against the face member to hold the face member in place, the surface area of the bezel having two slots symmetrically located therein;

a spring means including a flat plate shaped to fit within the rim and against the surface area of the bezel, said spring means having two prongs extending substantially at right angles from the flat plate, and being constructed and arranged to fit through the two slots located in the surface area of the bezel, the flat plate of the spring means being located between the surface area of the bezel and the face member to form one rigid unit;

a jewelry base member; and a mounting platform rigidly affixed to the jewelry base member including a flat member with two slots through it to receive the prongs of the spring means to hold the bezel and face member on the jewelry base.

6. An apparatus according to claim 5 wherein the flat member is a flat plate.

7. An apparatus according to claim 5 wherein the flat member is a flat circular plate with the two slots through it being substantially symmetrically located on the flat circular plate.

* * * * *